US007290297B2

(12) United States Patent
Cunerty

(10) Patent No.: US 7,290,297 B2
(45) Date of Patent: Nov. 6, 2007

(54) ADJUSTABLE MOUNT FOR A SPA COVER LIFTING DEVICE

(75) Inventor: John Cunerty, 46 Robin Hood Road, Toronto, Ontario (CA) M9A 2W8

(73) Assignee: John Cunerty, Mississauga (CA)

( * ) Notice: Subject to any disclaimer, the term of this patent is extended or adjusted under 35 U.S.C. 154(b) by 0 days.

(21) Appl. No.: 11/425,614

(22) Filed: Jun. 21, 2006

(65) Prior Publication Data

US 2006/0230513 A1 Oct. 19, 2006

Related U.S. Application Data

(63) Continuation-in-part of application No. 10/465,784, filed on Jun. 20, 2003, now abandoned.

(60) Provisional application No. 60/389,923, filed on Jun. 20, 2002.

(51) Int. Cl.
*E04H 4/06* (2006.01)

(52) U.S. Cl. ..... 4/498; 248/286.1

(58) Field of Classification Search ..... 4/498; 49/388, 402; 180/69.21; 220/845; 224/504; 16/223; 248/284.1, 286.1; 403/109.2, 109.6
See application file for complete search history.

(56) References Cited

U.S. PATENT DOCUMENTS 467,991 A * 2/1892 Frederick ..... 248/284.1 X
4,853,985 A 8/1989 Perry
4,991,238 A 2/1991 Forrest
5,029,740 A 7/1991 Cox
5,048,153 A 9/1991 Wall et al.
5,131,102 A 7/1992 Sailey et al.
5,224,636 A * 7/1993 Bounds ..... 224/504 X
5,367,722 A 11/1994 Pesterfield
5,373,590 A 12/1994 Svae et al.
5,471,685 A * 12/1995 Cross ..... 4/500
5,517,703 A 5/1996 Ouelette
5,566,403 A 10/1996 Black et al.
5,584,081 A 12/1996 Ouelette
5,634,218 A 6/1997 Ouelette
5,644,803 A 7/1997 Wilson
5,689,841 A 11/1997 Black et al.

(Continued)

FOREIGN PATENT DOCUMENTS

CA 2053858 9/1991

(Continued)

OTHER PUBLICATIONS

COVER-UPI advertisements, 2 pgs., no date given.

(Continued)

*Primary Examiner*—Robert M. Fetsuga
(74) *Attorney, Agent, or Firm*—Bereskin & Parr

(57) ABSTRACT

An adjustable lifting device for a spa cover has a frame for securing to the spa cover and at least one extendible mount for adjustably extending a distance between the frame of the lifting device and a mounting point on the housing of a spa. The extendible mount has an extendible member attached to the frame of the lifting device, and a mounting bracket adapted to be fixed at a mounting location on the housing of a spa. The extendible member is adjustably coupled to the mounting bracket.

4 Claims, 11 Drawing Sheets

U.S. PATENT DOCUMENTS

| | | | |
|---|---|---|---|
| 5,745,932 | A | 5/1998 | Barovetto |
| 5,819,332 | A | 10/1998 | Perry |
| 5,950,252 | A | 9/1999 | Fettes |
| 5,974,599 | A | 11/1999 | Tudor |
| 5,974,600 | A | 11/1999 | Pucci et al. |
| 5,996,137 | A | 12/1999 | Genova |
| 6,000,071 | A | 12/1999 | Fettes |
| 6,032,305 | A | 3/2000 | Tedrick |
| 6,158,063 | A | 12/2000 | Tudor |
| 6,195,811 | B1 | 3/2001 | Dragovic |
| 6,381,766 | B1 | 5/2002 | Perry |

FOREIGN PATENT DOCUMENTS

| | | |
|---|---|---|
| CA | 2098974 | 12/1994 |
| CA | 2155988 | 5/1996 |
| CA | 2282012 | 9/1999 |
| CA | 2298306 | 1/2001 |
| WO | WO-91/13224 | 9/1991 |

OTHER PUBLICATIONS

Installation Instructions for the COVER-UPI, 4 pgs., no date given.
Cover Caddy advertisement, 1 pg., no date given.
Cover Caddy Assembly & Mounting instructions, 3 pgs., no date given.
CoverShelf advertisement, 1 pg., no date given.
Covermate I advertisement, 2 pgs., no date given.
Installation Instruction for the Covermate I, 4 pgs., no date given.
Covermate II advertisement, 2 pgs., no date given.
Installation Instructions for the Covermaste II, 7 pgs., no date given.
Installation Instructions for the Covermate III, 4 pgs., no date given.
The Cover Valet advertisement, 2 pgs., no date given.
Installation Instructions for the Cover Valet, 3 pgs., no date given.
The Ideal E-Z Lifter advertisement, 2 pgs., no date given.
The Ideal E-Z Lifter Installation Instructions, 7 pgs., no date given.
The Ideal Cover Lift advertisement, 2 pgs., no date given.
The Ideal Cover Lift Installation Instructions, 4 pgs., no date given.
COVER ROCK-IT advertisement, 1 pg., no date given.
COVER ROCK-IT Assembly and Installation Instructions, 4 pgs., no date given.
Superlift2 advertisement, 1 pg., no date given.
Superlift2 Installation Guide, 7 pgs., no date given.

* cited by examiner

ADJUSTABLE MOUNT FOR A SPA COVER LIFTING DEVICE

This application is a continuation-in-part of prior U.S. application Ser. No. 10/465,784, filed Jun. 20, 2003, now abandoned, which claims the benefit of Provisional Application No. 60/389,923, filed Jun. 20, 2002, each of which are hereby incorporated herein by reference.

FIELD

This specification relates to an adjustable mount for a spa cover lifting device. More particularly, this specification relates to providing a spa cover lifting device that can be fitted to a variety of shapes of spa housings.

BACKGROUND

Covers for spas (spas are also known as "hot tubs") are used to minimize escape of heat from the spa when the spa is not in use. A typical cover can be formed from thick rigid insulating sheets that are covered with fabric. The spa cover is typically displaceable so that the cover can be removed from the spa when the spa is in use. This is often achieved by dividing the cover into portions, folding one portion of the cover onto at least another cover portion, then lifting the folded cover from the spa, usually by swinging the folded cover about a pivot.

SUMMARY

The following summary is intended to introduce the reader to the applicant's teaching disclosed herein but not to define any invention. In general, disclosed are one or more methods or apparatuses for an adjustable mount for a spa cover lifting device, enabling the spa cover lifting device to be used with a variety of shapes of spa housings and, for certain examples, to also accommodate a variety of materials used in the construction of spa housings.

In one aspect of the applicant's teaching disclosed herein, an adjustable mount is provided for fitting the frame of a spa cover lifting device to a spa. In another aspect, an adjustable lifting device for a spa cover is provided. The lifting device has a frame for securing the device to the spa cover, and at least one adjustable mount for fitting the lifting device to a spa.

The adjustable mount has a bracket adapted to fit the spa, and an extendible member adjustably coupled to the bracket and adapted to attach to the frame of the spa cover lifting device. In a preferred example disclosed, the extendible member attaches to the frame of the spa cover lifting device through a displaceable connection, such as, for example, a pivotal joint.

The bracket can have a hollow channel for slideably receiving at least a portion of the extendible member. A locking means can also be provided to fix the position of the extendible member relative to the bracket.

In one example of the specification the bracket is secured to the spa housing through suitable fasteners, such as, for example, but not limited to, screws.

A spacer block can be provided adjacent the bracket of the adjustable mount, the spacer block having one face adapted to match the surface of a suitable mounting location on the spa housing, and another face adapted to support the bracket. This can further assist in fitting the adjustable mount to a variety of shapes of spa housings.

In another aspect, the bracket for the adjustable mount can be adapted to rest on a surface that the spa sits or rests on. The bracket can be provided with at least one extended flange upon which the spa can rest. For this example, the bracket is held in place by the weight of the spa on the flange. If desired, the flange of the bracket could be secured through suitable fasteners to the underside of the spa.

In further alternative examples, the bracket could be secured to a suitable support with fasteners, such as, for example, but not limited to, screws. The bracket is positioned with respect to the spa to enable the spa cover lifting device displace the cover so that it can be removed when the spa is in use.

For these examples, however, the bracket does not need to be secured to the spa housing, which is useful where the spa housing is manufactured from, for example, a composite plastic, or other material that might not have sufficient strength to support the spa cover lifting device.

Other aspects and features of the present teaching will become apparent, to those ordinarily skilled in the art, upon review of the following description of specific examples.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
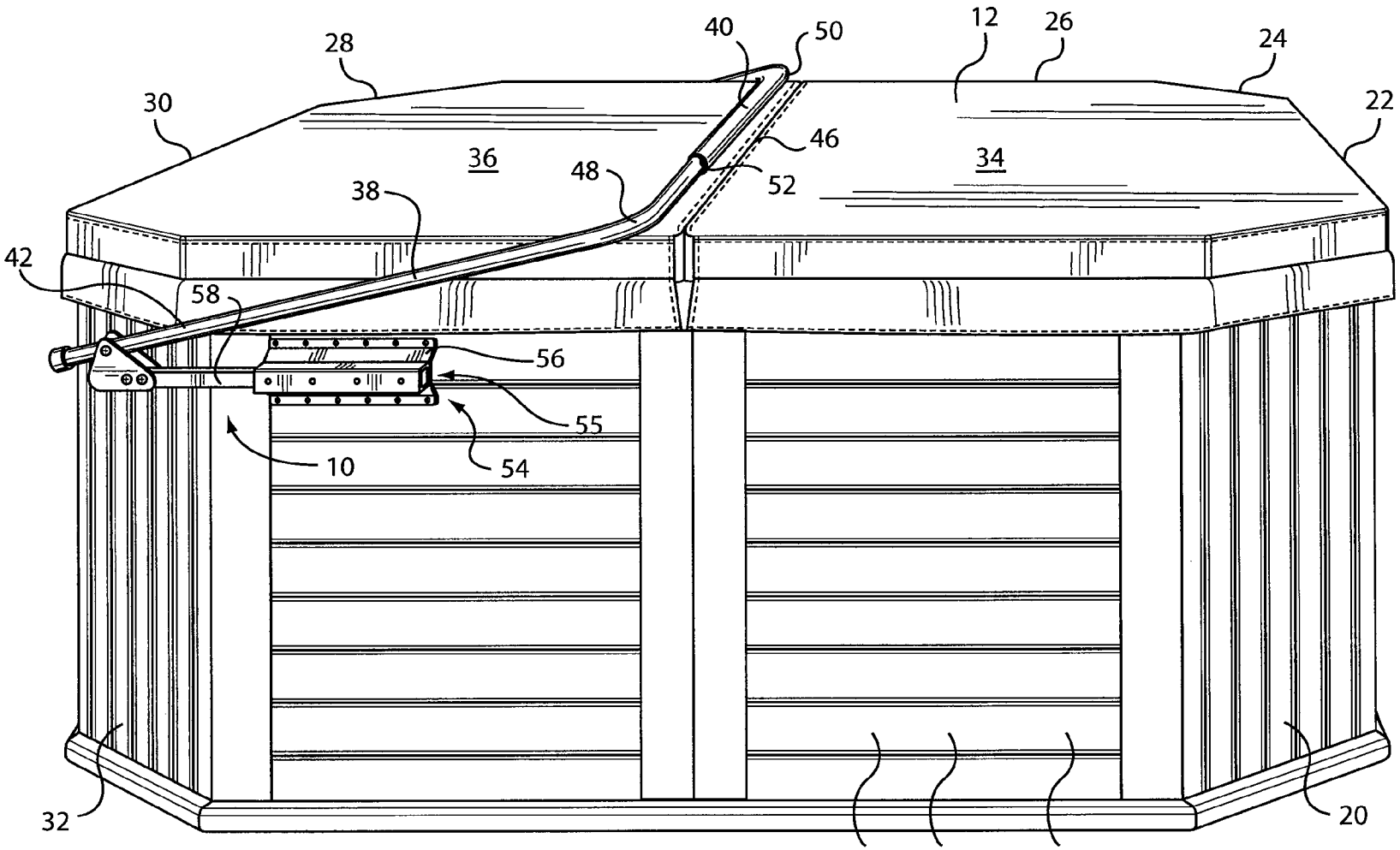
FIG. 1 is a perspective view of a spa cover lifting device installed on a spa and with the cover in a closed position.

A spa cover lifting device that can be fitted to a variety of shapes of spa housings is generally shown at 10 in FIG. 1. The spa cover lifting device is secured to a spa cover 12, as will hereinafter be described. The spa cover lifting device is also generally fitted to a spa 14 in a manner that allows the spa cover 12 to be displaced so that the cover 12 can be removed from the spa 14, as will hereinafter be described.

The spa 14 generally comprises a housing 16. The spa 14 can feature a housing in a variety of shapes. For the example illustrated in FIG. 1, housing 16 is generally octagonal having eight sides 18, 20, 22, 24, 26, 28, 30, and 32. It can be appreciated, however, that this teaching contemplates mounting a spa cover lifting device 10 to a variety of shapes of housings, including those housings that might not have rectilinear wall portions. For example, the housing 16 could comprise curved wall panels, or a combination of rectilinear and curved wall panels.

Figure 2:
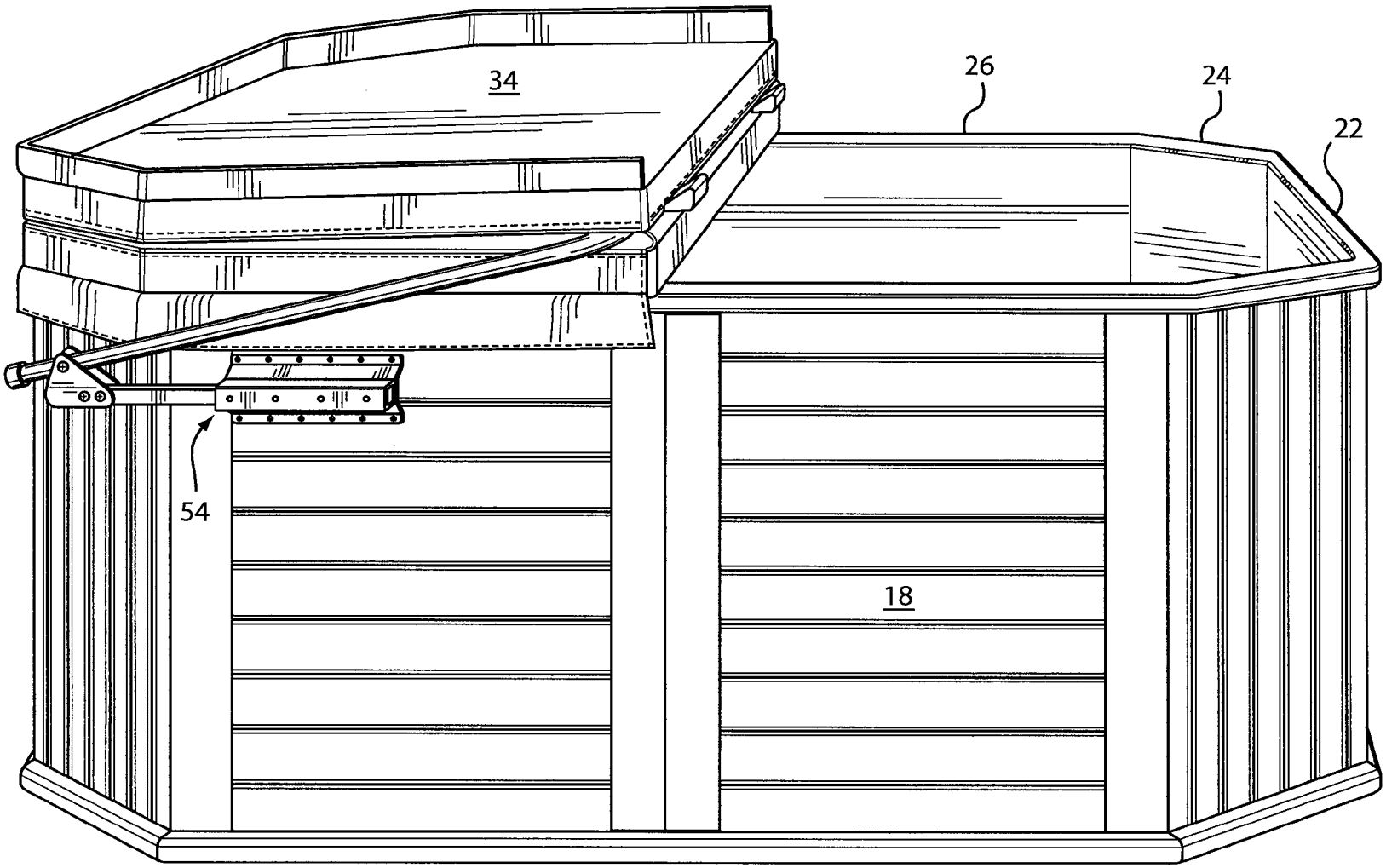
FIG. 2 is a perspective view similar to FIG. 1 but showing one portion of the spa cover folded onto another portion.
Figure 3:
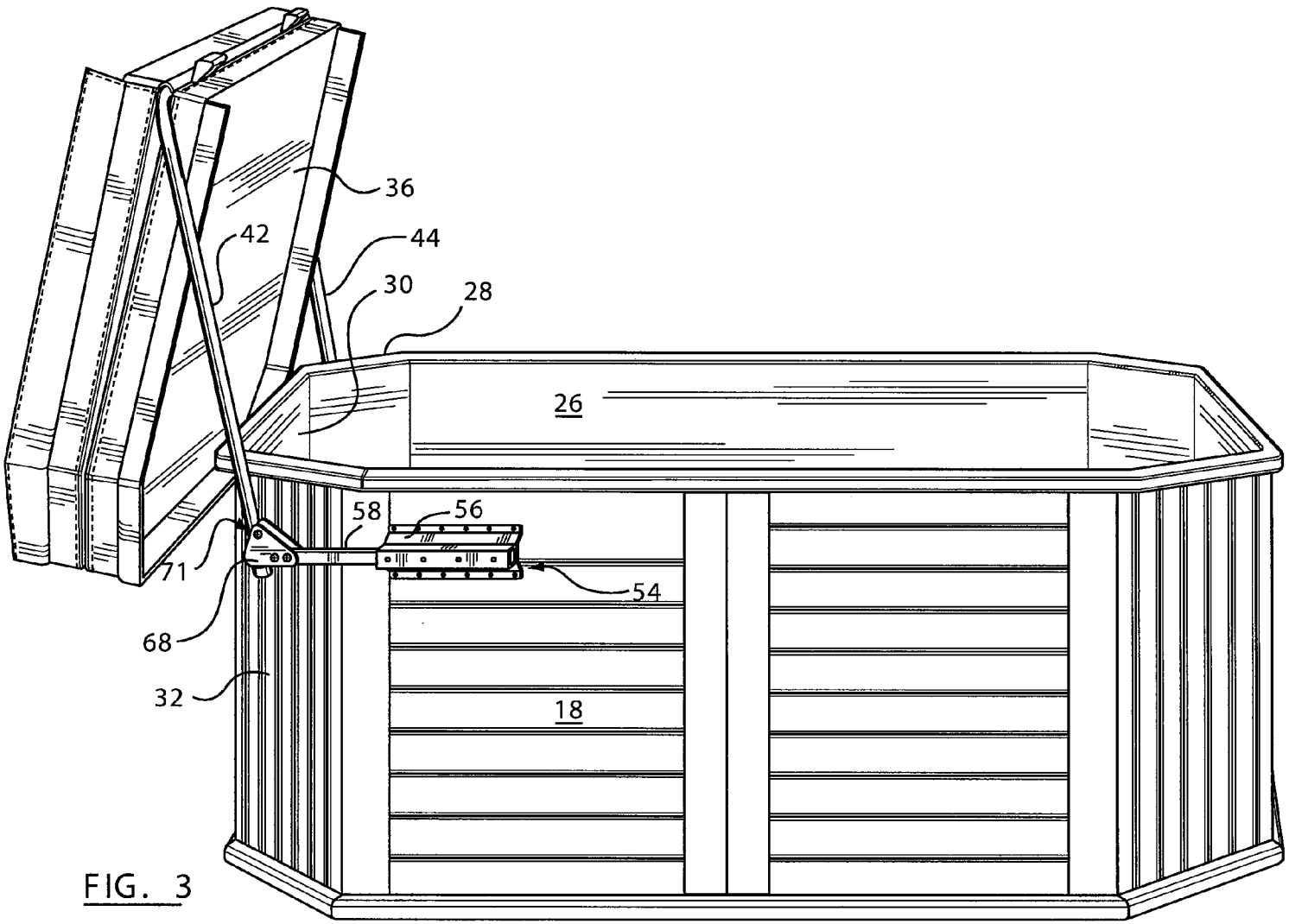
FIG. 3 is a perspective similar to FIG. 1 but showing a spa cover frame swung about a pivot so that the spa cover is lifted completely from the spa.

The spa cover 12 can be formed from a thick rigid insulating sheet covered with a fabric. The spa cover 12 is divided into portions, and, for the example illustrated, is divided into two portions 34, 36. To remove the spa cover 12 from the spa 14, the spa cover portion 34 is typically folded onto the spa cover portion 36, as illustrated in FIG. 2. Then the folded spa cover 12 is moved clear of the spa 14, using the spa cover lifting device 10, as illustrated in FIG. 3.

In the example illustrated, the spa cover lifting device 10 generally comprises a U-shaped frame 38 that comprises a cross-member 40 and support arms 42 and 44. Alternate frame configurations can also be used, such as, for example, L-shaped frames having a cross-member and a single arm. The cross-member 40 is secured to the spa cover 12 as illustrated in FIG. 1. In general, the cross-member 40 is secured to the spa cover 12 near the fold line 46 between the portions 34 and 36 of the spa cover 12. The cross-member 40 can be secured to the spa cover 12 by any suitable fastener, such as, for example, but not limited to, bolts and screws and adhesives, or by fabric extending from the spa cover and looped over the cross-member 40. By securing the cross member 40 and the spa cover 12 together, the frame 38 is secured over at least a portion (i.e., cross-member 40) thereof to the spa cover 12.

Figure 6:
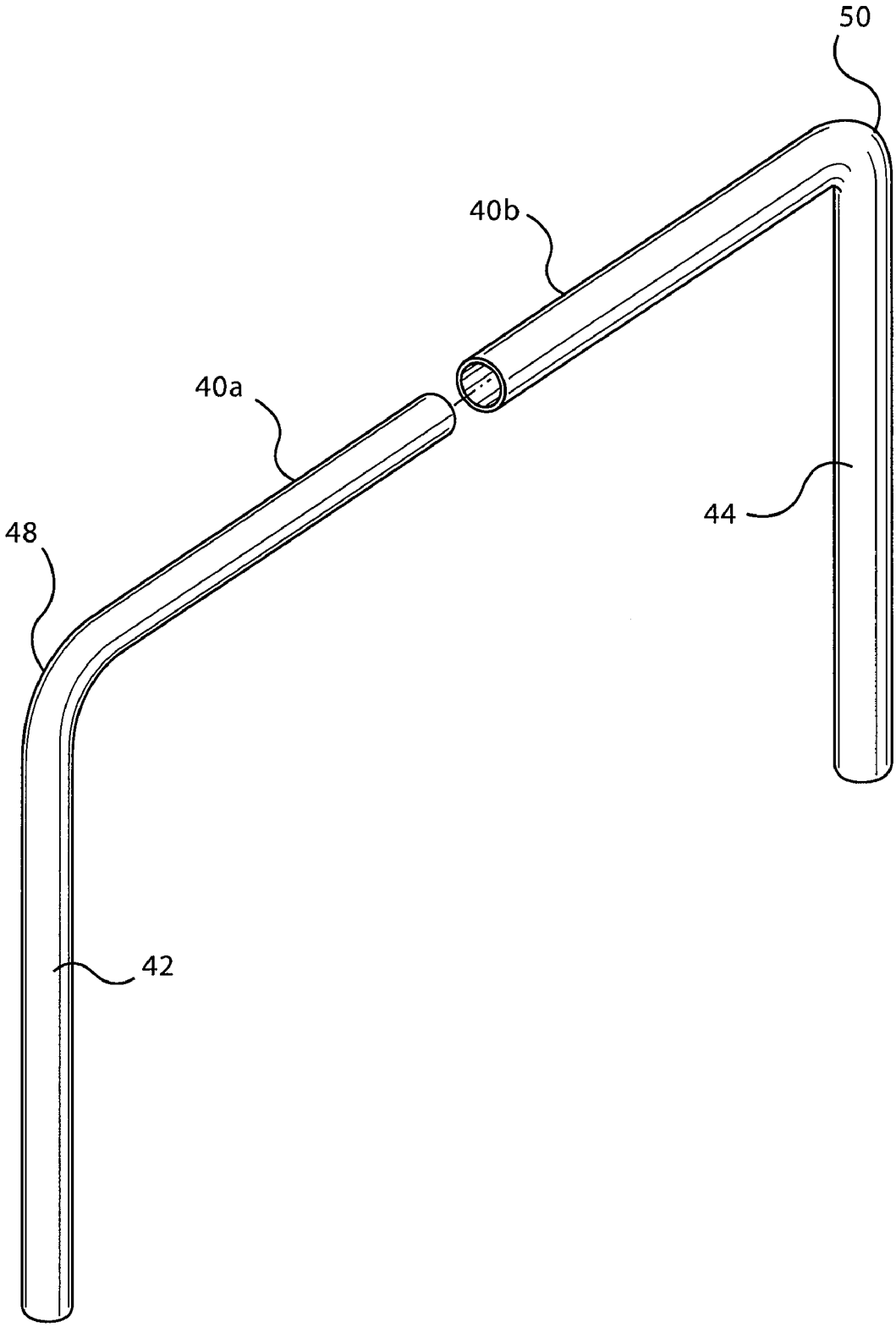
FIG. 6 is an exploded perspective view of the spa cover frame.

For the example illustrated, the U-shaped frame 38 comprises two corner elements 48, 50. As shown in FIG. 6, corner element 48 is formed from support arm 42 and a portion 40*a* of the cross member 40, while the second corner element 50 is formed from the support arm 44 and another portion 40*b* of the cross member 40.

The corner elements 48, 50 may be constructed of tubular material having a generally circular cross-section, with the material of one of the cross-member portions 40*a* having a slightly smaller diameter than the other cross-member portion 40*b*. This permits one of the corner elements to fit within the other in a snug telescoping arrangement as at 52. The telescoping arrangement of the two corner elements 48, 50 allows the cross member 40 to be sized to fit generally across the width of the spa cover 12.

To mount the frame 38 of the spa cover lifting device 10 to the spa 14 an adjustable mount 54 is provided. For the example illustrated, the adjustable mount 54 comprises a bracket 56 adapted to be fixed adjacent the spa 14, and an extendible member 58 that is adjustably coupled to the bracket 56.

Figure 4:
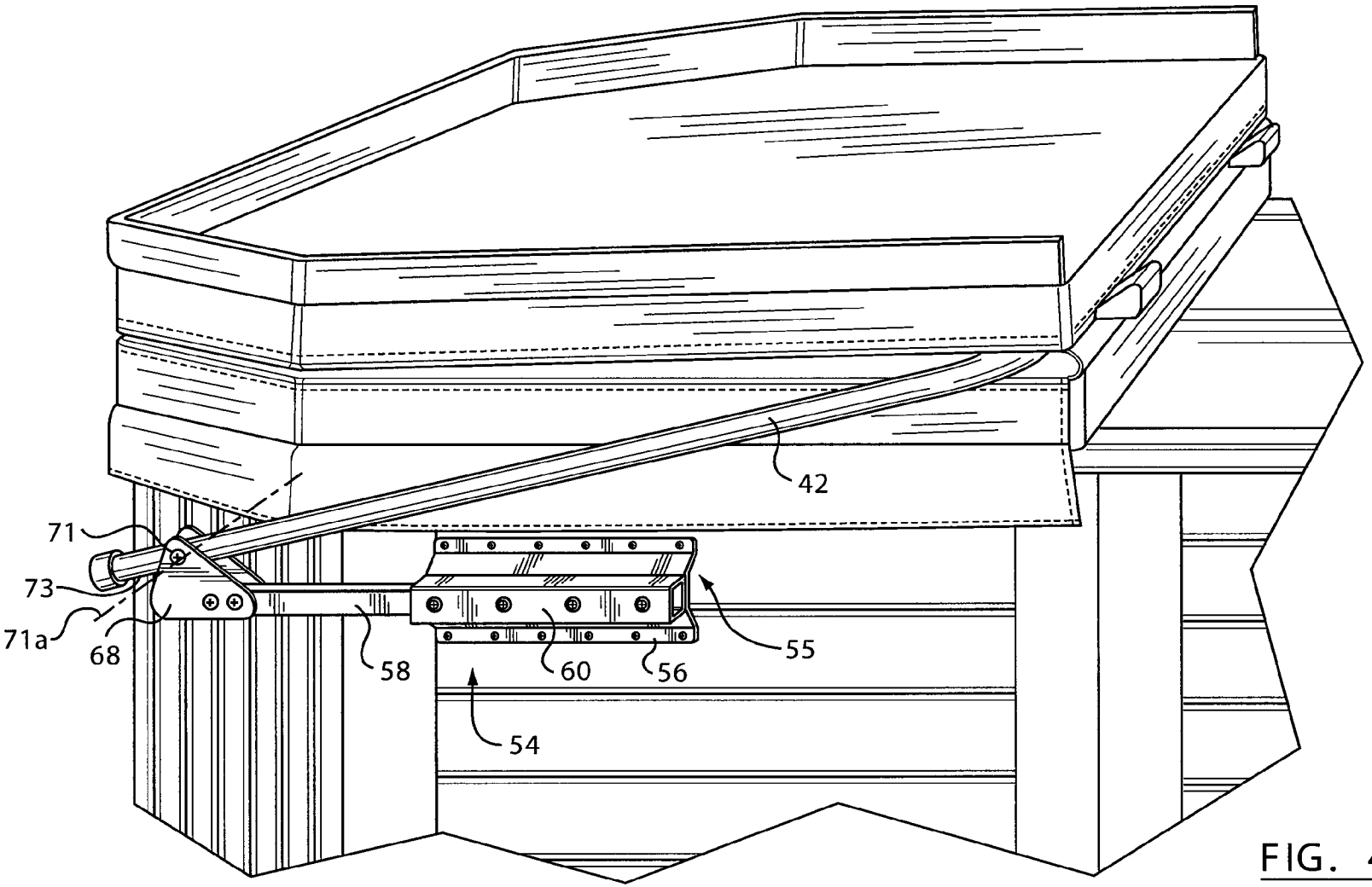
FIG. 4 is a more detailed view of the adjustable mount of this specification attached to a spa housing.
Figure 5:
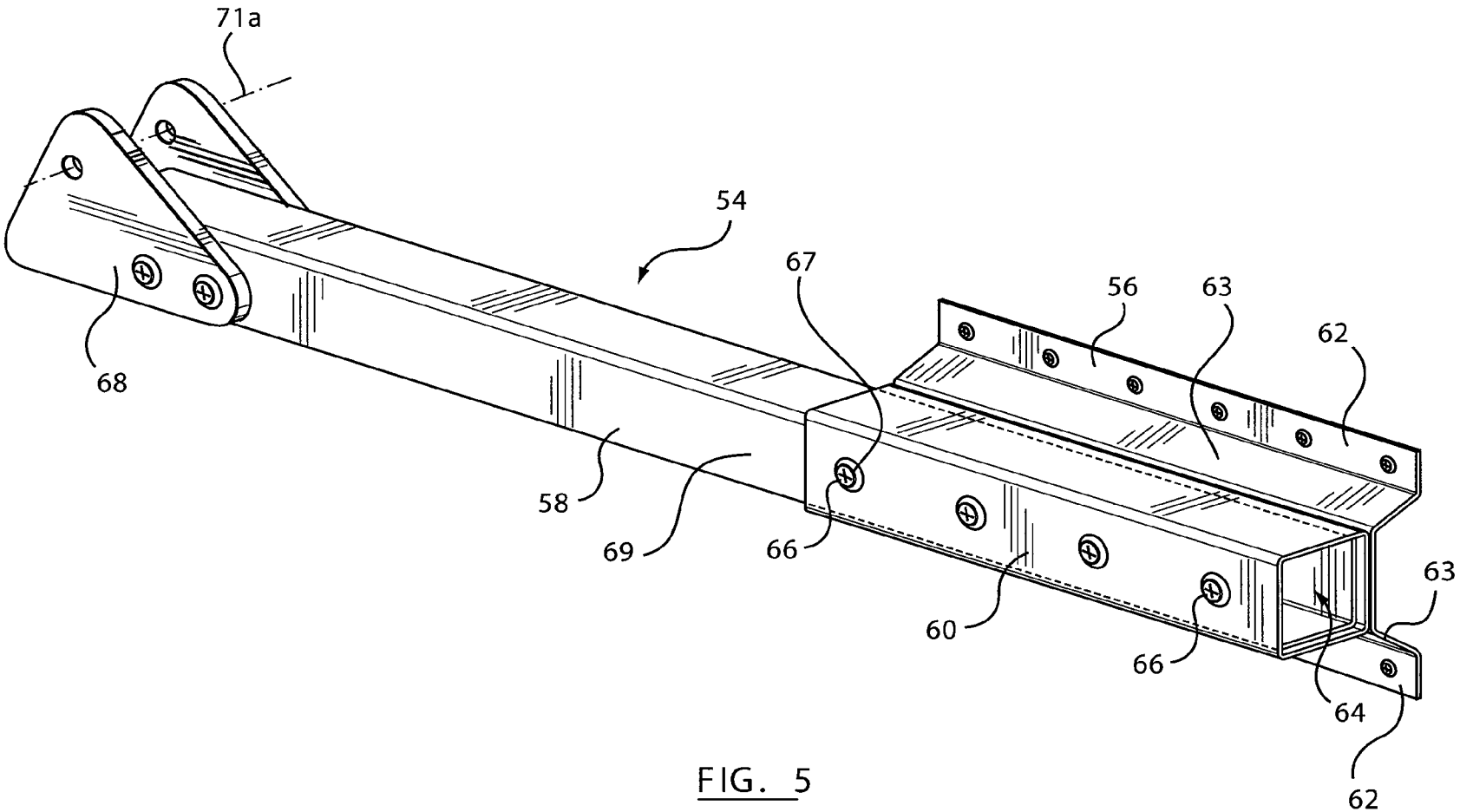
FIG. 5 is a detailed view of the adjustable mount of this specification.

As best illustrated in FIGS. 4 and 5, the bracket 56 comprises a body portion 60, adapted to slideably receive the extendible member 58, and attachment elements 62 extending from the body 60, for securely fastening the bracket 56 to any suitable mounting location 55 on the housing 16 of the spa 14. In the example illustrated, attachment elements 62 are provided in the form of flanges adapted to receive suitable fasteners, such as, for example, but not limited to, bolts and screws. It can be appreciated that attachment elements 62 can space or offset body portion 60 away from the housing 16 (by offset members 63 in FIG. 5) of the spa 14, so that the housing 16 will not interfere with the displacement of the spa cover lifting device. Two brackets are provided for the example disclosed, one for each support arm 42, 44 of the U-shaped frame 38. Each of the brackets 56 is securely fastened to generally opposed sidewalls of the spa 14.

The body portion 60 of the bracket 56 generally comprises a hollow channel 64 of a slightly larger cross-section of the extendible member 58 so that the extendible member 58 can be slideably received within the hollow channel 64.

As mentioned, the extendable member 58 is, for the example illustrated, sized to fit slideably through the hollow channel 64 of the body portion 60 of the mounting bracket 56. In this way, the extendible member 58 is displacedly coupled to the bracket 56. For the example shown, the extendible member 58 also has a square cross section, though of a slightly smaller dimension than the cross section of the hollow channel 64 of the body portion 60 of the mounting bracket 56. It can be appreciated that other configurations of the extendible member 58 and the body portion 60 can be used. For example, but not to be considered limiting, the extendible member could be a sleeve that is slideably disposed over the body portion 60, or an externally threaded rod adapted to engage an internally threaded bore in body portion 60.

Once the extendible member 58 is adjusted in relation to the body portion 60 of the bracket 56, as will hereinafter be described, suitable locking means 66, such as, for example, but not limited to, bolts, screws, pins, and stop collars, can be used to secure the position of the extendible member 58 relative to the body portion 60 of the bracket 56.

For the example shown in FIG. 5, a fastener 67, such as a screw, can be used to secure the extendible member 58 in place by either passing through matching fastener-receiving holes in the extendible member 58 or by bearing against surface 69 of the extendible member 58 to grip the extendible member 58 against further displacement within hollow channel 64.

The extendible member 58 includes at one end thereof a connection portion (also called connection means 68) for connecting the frame 38 to the extendible mount 54. The connection means 68 can comprise, for example, but without limitation, a hole, a pin, or merely a portion of the surface of the extendible member 58. For the example illustrated, the connection means 68 comprises a pivot connection 71 (also referred to herein as pivotal connection 71) provided between a respective support arm 42, 44 of the frame 38 and secured to the corresponding extendible member 58. The pivotal connection 71 defines a pivot axis 71*a*, and allows the spa cover 12 to be removed from the spa 14 by swinging the frame 38, with the attached spa cover 12, upward and away from the spa 14, about the pivot axis 71*a* of the pivotal connection 71. As seen from FIGS. 3 and 4, a surface 73 of the respective support arm 42, 44 abuts the end of extendible member 58 within connection means 68 to stop further displacement of the spa cover lifting device, as shown in FIG. 3.

Figure 7:
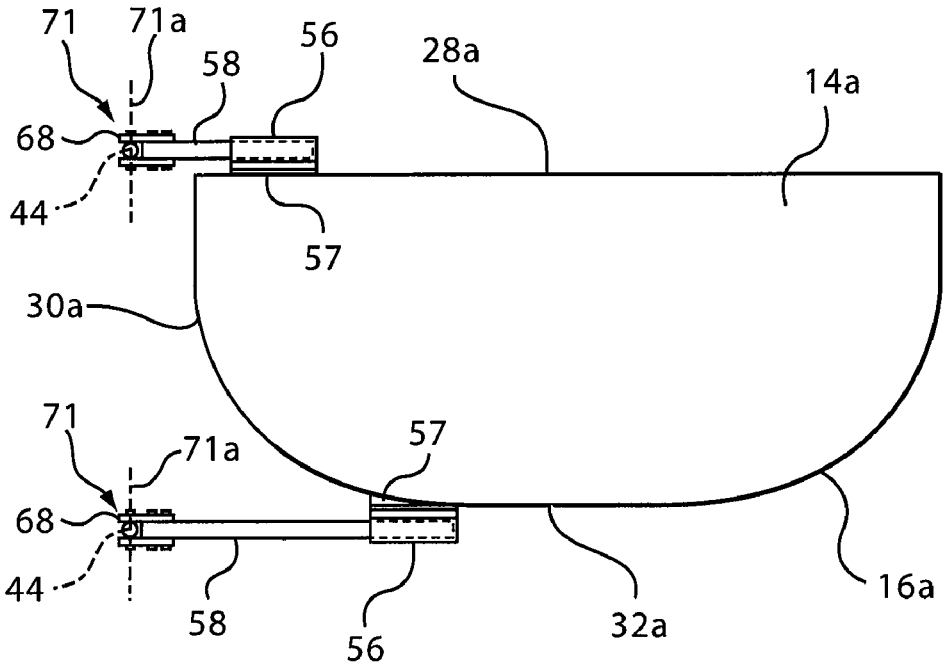
FIG. 7 is a top plan view showing use of the adjustable mount of this specification with a spa having a housing with at least two opposing side different shapes.
Figure 8:
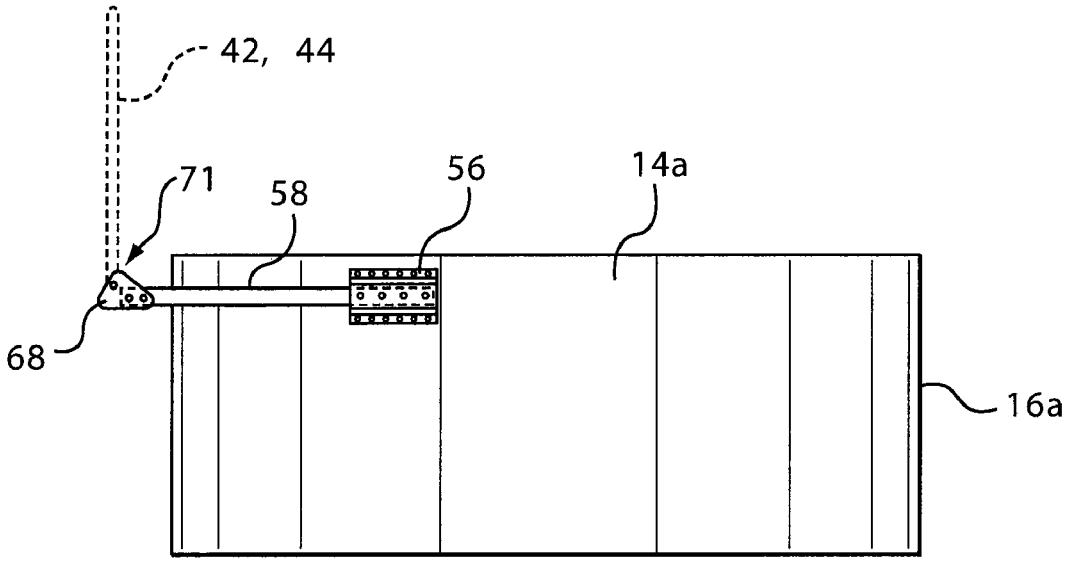
FIG. 8 is a side elevational view of the spa shown in FIG. 7.

In use, an L-shaped frame having a single arm can be mounted adjacent the spa 14 using a single bracket 56. For the U-shaped frame 38 of the example illustrated, a pair of brackets 56 can be used. Each one of the pair of brackets 56 can be secured to opposed regions of the spa 14. In general, this would be on opposed sidewall portions of the housing 16 of the spa 14, such as sides 18, 26 of the spa 14 illustrated in FIG. 1. Securing the brackets 56 on opposed, parallel sidewalls provides for generally parallel adjustable mounts 54. However, it can be appreciated that the brackets 56 do not need to be directly opposite from one another. For example, side 28*a* of the spa 14 can be longer than side 32*a*. Accordingly, the bracket on side 32*a* would be further away from side 30*a* than the bracket on side 28*a*. Such an arrangement is contemplated by the present teaching. Appropriate adjustment of the corresponding extendible members 58 can be made so that the respective pivot connections 71 of the spa cover lifting device 10 are opposed to each other, as illustrated in FIG. 7, for example.

For certain shapes of housing 16*a* of spa 14*a* it might be necessary to provide a spacing block 57. For example, if side 32*a* were not parallel to side 28*a* for the spa illustrated in FIG. 7, then spacer block 57 can be secured to one side so that the mounting brackets can be secured to the spa 14 in a manner that ensures that the extendible members 58 are parallel. Other types of spacer blocks could be used if the sidewalls of the spa housing were, for example, curvilinear, or combinations of curved and rectilinear shapes.

Once the adjustable brackets 56 are in place, the extendible members 58 can be fitted into the hollow channel 64 presented by the body portions 60 of the brackets 56. The extendible members 58, and hence the pivotal connections 71, are displaceable relative to the brackets 56, and can be adjusted so that the respective pivotal connections 71 (for connection to the support arms 42, 44) are directly opposite to one another. Moreover, the extendible members 58 can be adjusted so that the pivotal connections 71 are located sufficiently away from the sides of the housing 16 of the spa 14, so that the spa cover 12 is free to swing about the pivotal connection 71 away from the spa 14. Typically the spa cover 12 is folded so that portion 34 overlies portion 36. A user can then grasp one of both of the support arms 42, 44 and swing the folded cover 12 about the pivotal connections 71 to the position illustrated in FIG. 3. Each extendible member 58 and connection portion 68 thereof adapted to remain generally stationary when the frame 38 is moved between the first and second frame positions, as seen with reference to FIGS. 2 and 3.

Figure 9:
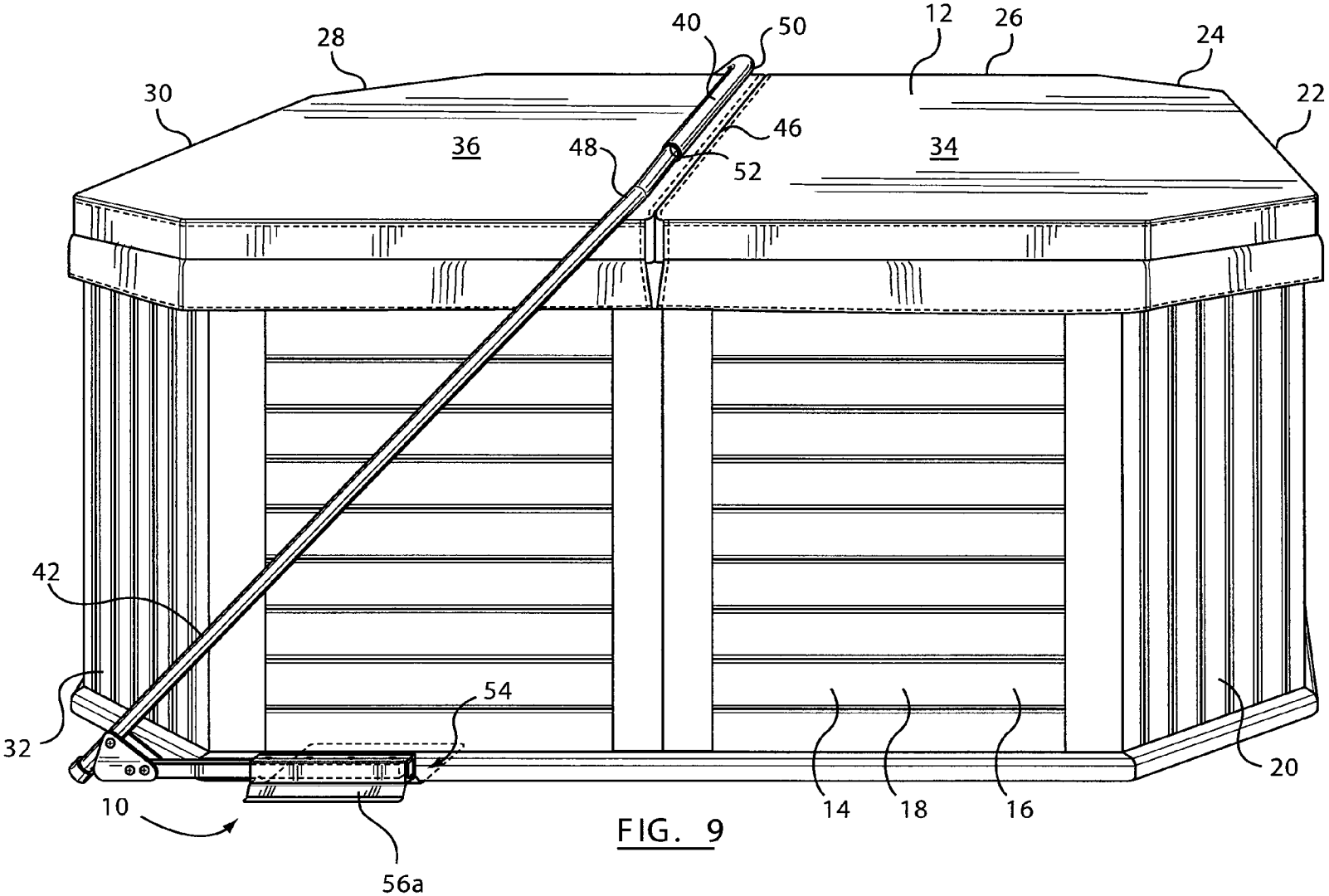
FIG. 9 is a perspective view similar to FIG. 1 showing an alternative example of the adjustable mount.
Figure 10:
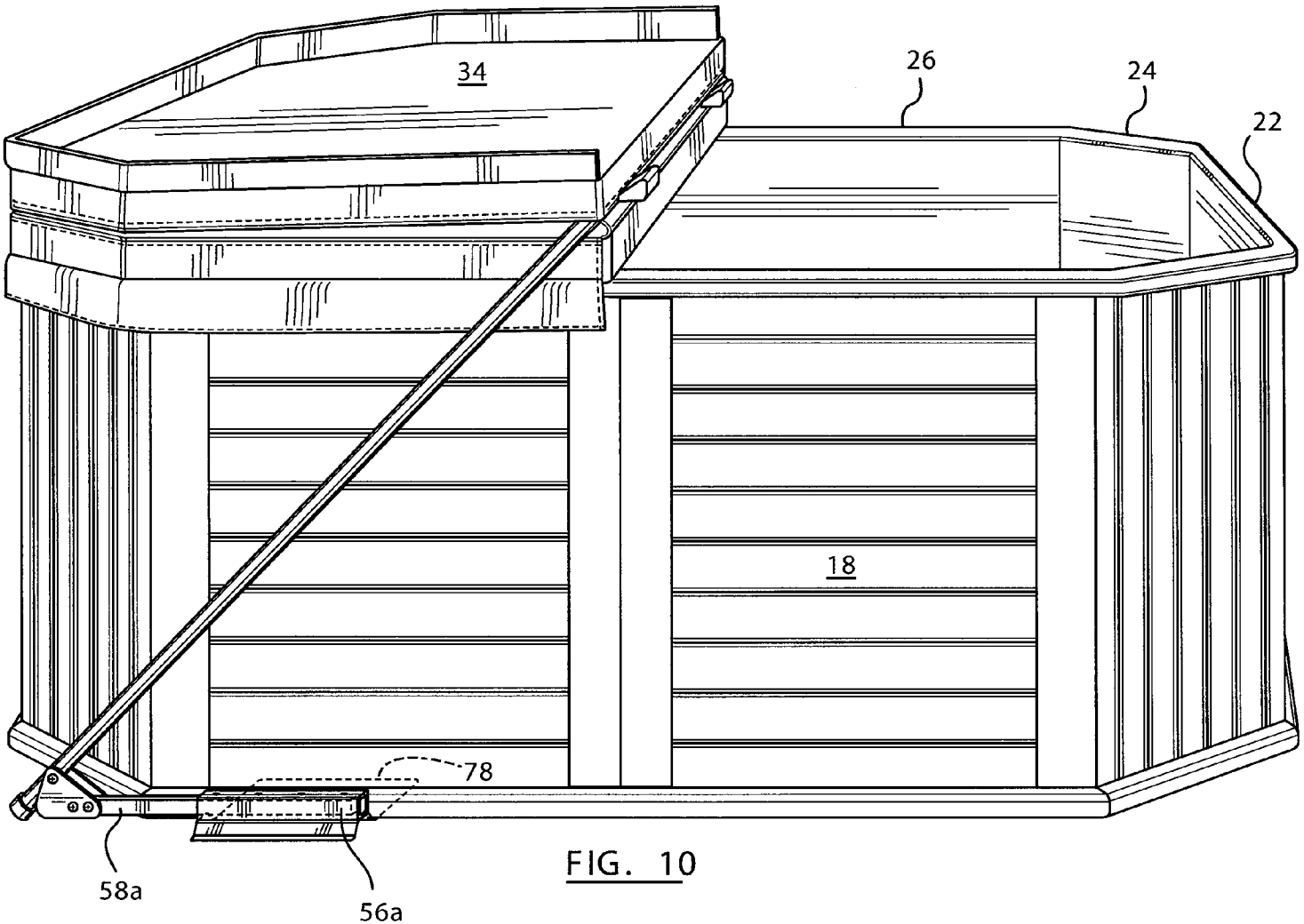
FIG. 10 is a perspective view similar to FIG. 9, but showing one portion of the spa cover folded onto another portion.
Figure 11:
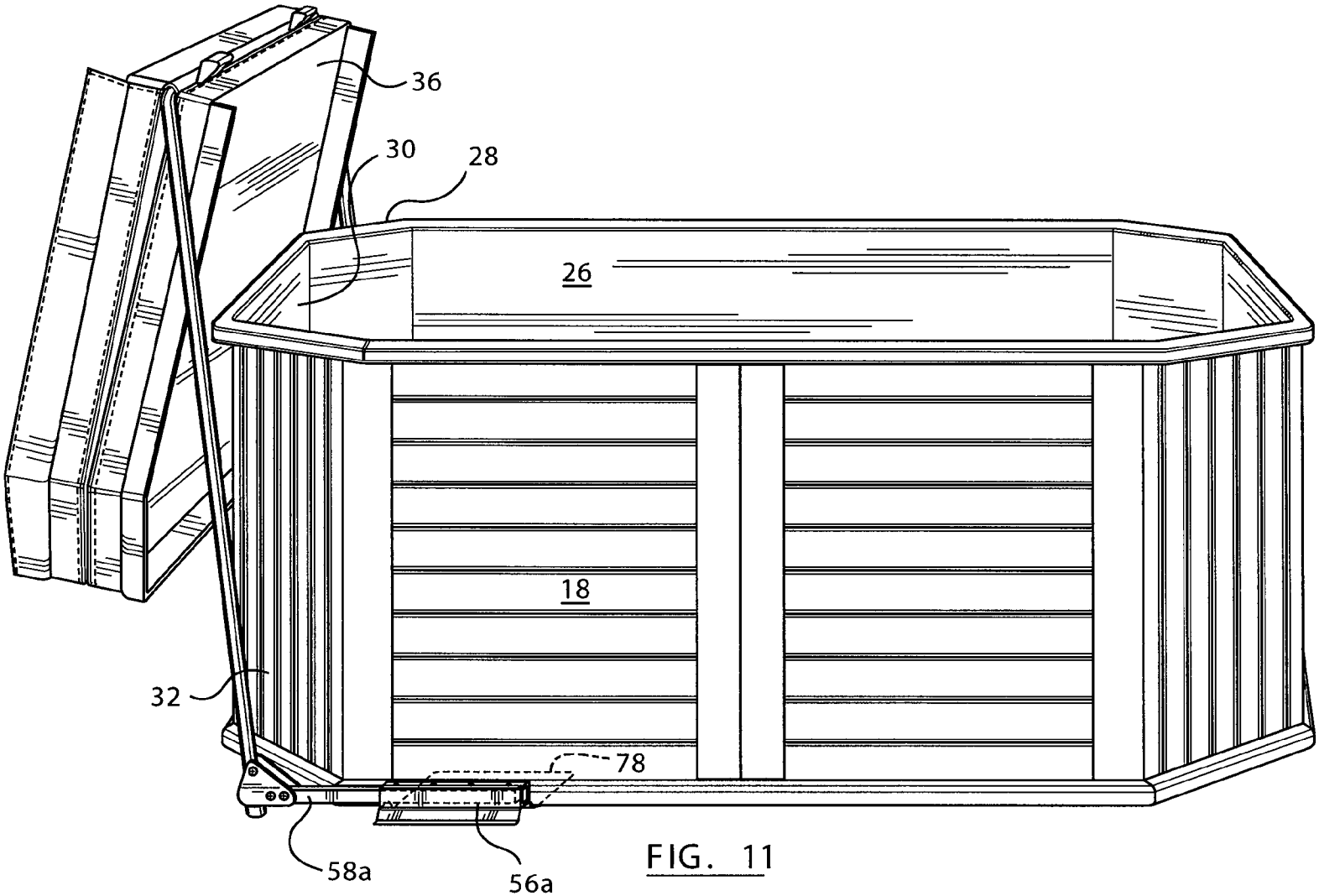
FIG. 11 is a perspective view similar to FIG. 9 but showing the spa cover frame swung about a pivot so that the spa cover is lifted completely from the spa.

FIGS. 9 through 11 illustrate an alternative example of an adjustable mount. All the components of the adjustable mount are identical as in the example previously described, with the exception of the bracket as described below.

In particular, spa housings are increasingly being made of materials other than wood, such as, for example, composite plastic. Such material will not support, for example, screws that can be used to secure a bracket to the spa housing.

Figure 9A:
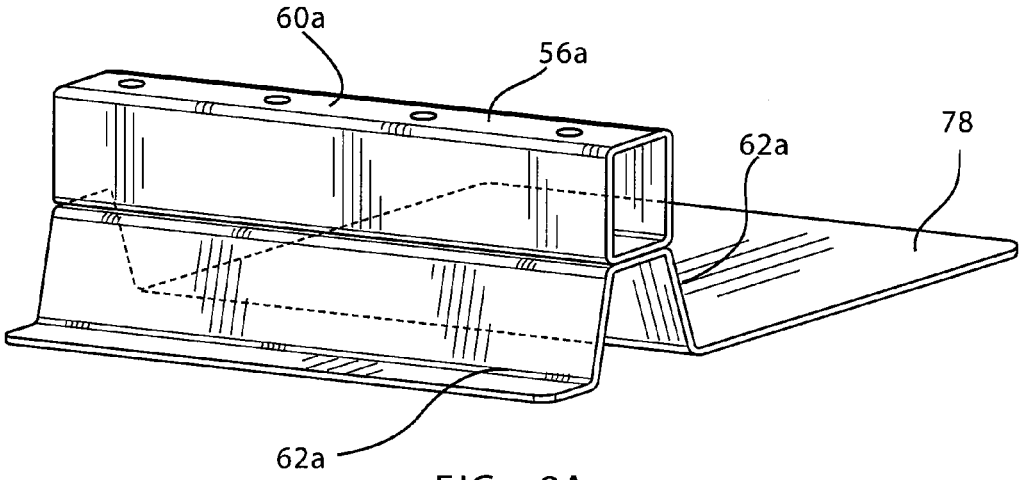
FIG. 9A is a perspective view from one side of the bracket of the adjustable mount shown in FIG. 9.
Figure 9B:
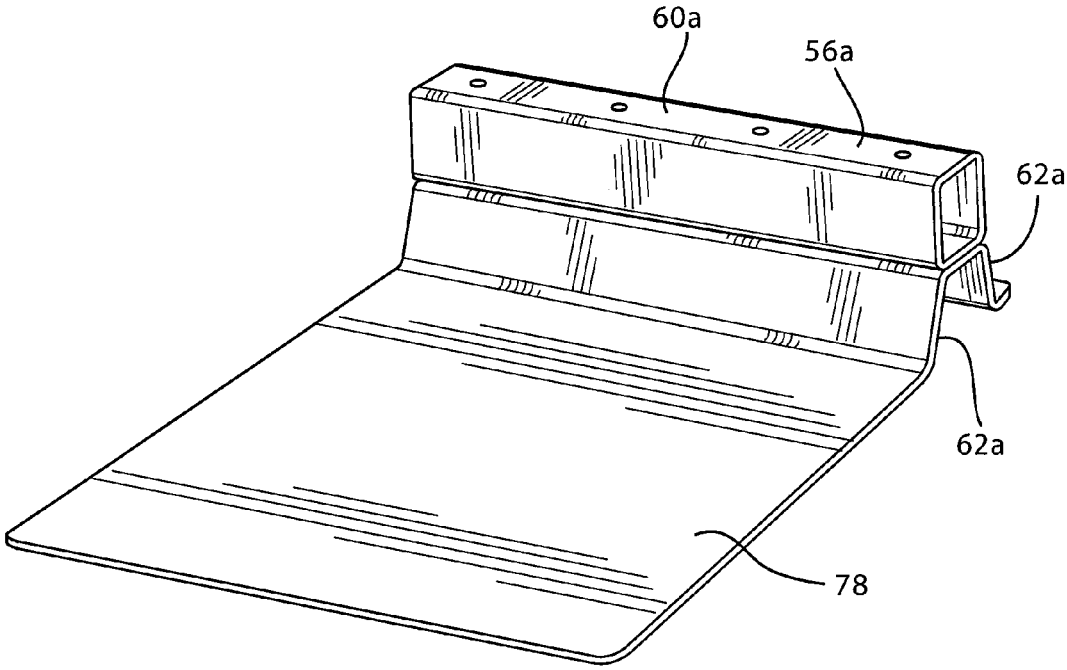
FIG. 9B is a perspective view from another side of the bracket of the adjustable mount shown in FIG. 9.

Accordingly, an alternative bracket has been designed which is identical to the bracket disclosed in the first example with the exception that, at least one of the attachment elements 62*a*, is an extended flange 78, as best illustrated in FIGS. 9*a* and 9*b*. As illustrated in FIG. 9, the spa 12 can rest upon the extended flange 78. It can be appreciated, that for this example, the bracket can rest on a surface that the spa sits or rests on so the bracket can be held in place by the weight of the spa on the extended flange 78. If desired, the extended flange 78 could be secured with suitable fasteners, such as, for example, but not limited to, screws, bolts, etc., to the underside of the spa.

In further alternative examples, the bracket could be secured to other suitable supports through fasteners, so long as the adjustable mounts position the spa cover lifting device in a manner that the spa cover can be displaced so as to be removed from the spa when the spa is in use.

While the above description provides examples of one or more processes or apparatuses, it will be appreciated that other processes or apparatuses may be within the scope of the accompanying claims.

The invention claimed is:

1. An adjustable lifting device for a spa cover, the device comprising:

a) a frame adapted to be secured over at least a portion thereof to a spa cover, the frame movable between a first frame position wherein the spa cover generally covers a spa and a second frame position wherein the spa cover is lifted from the spa;

b) a first bracket and a second bracket, each bracket adapted to be fixed adjacent opposing sides of the spa; and c) a first extendible member having a first connection portion attached to the frame, and a second extendible member having a second connection portion attached to the frame, each extendible member being displacedly coupled to the respective first and second brackets, respectively, for adjusting a spacing distance between each respective connection portion and the respective bracket when installing the lifting device at the spa, the first and second connection portions of the respective extendible members remaining generally stationary when the frame is moved between the first and second frame positions;

wherein each bracket comprises a body portion defining a hollow channel for slideably receiving therein a portion of each respective extendible member, and wherein each bracket comprises spaced apart flanges extending from the body portion, the flanges being generally aligned in a plane for bearing against a flat mounting surface.

2. The adjustable mount of claim 1 wherein each bracket comprises at least one offset member extending between the flanges and the body portion defining the channel for spacing apart the channel from the flanges in a direction normal to said plane.

3. An adjustable lifting device for removing and replacing a spa cover from a spa, the device comprising:

a) a frame adapted to be secured over at least a portion thereof to the spa cover, the frame movable between a first frame position wherein the spa cover generally covers the spa and a second frame position wherein the spa cover is lifted from the spa;

b) a first bracket and a second bracket, each bracket adapted to be fixed adjacent opposing sides of the spa;

c) a first pivot connection coupled to the first bracket and a second pivot connection coupled to the second bracket, each pivot connection being connected to the frame, the first and second pivot connections defining a pivot axis about which the frame can pivot, each bracket being displaceable relative to each respective pivot connection for allowing selective positioning of the pivot axis relative to each respective bracket; and d) a first and second extendible member slideably coupled to the first and second bracket, respectively;

wherein each bracket comprises a body portion defining a hollow channel for slideably receiving therein a portion of each respective extendible member, and wherein each bracket comprises spaced apart flanges extending from the body portion, the flanges being generally aligned in a plane for bearing against a flat mounting surface.

4. The adjustable lifting device of claim 3 wherein each bracket comprises at least one offset member extending between the flanges and the body portion defining the channel for spacing apart the channel from the flanges in a direction normal to said plane.

* * * * *